US007510059B2

(12) United States Patent
Reuter et al.

(10) Patent No.: US 7,510,059 B2
(45) Date of Patent: Mar. 31, 2009

(54) ROPE BRAKE

(75) Inventors: Guenter Reuter, Filderstadt (DE); Walter Nuebling, Ostfildern (DE); Wolfgang Meissner, Neuhausen (DE); Helmut Schlecker, Plochingen (DE)

(73) Assignee: ThyssenKrupp Elevator AG, Duesseldorf (DE)

( * ) Notice: Subject to any disclaimer, the term of this patent is extended or adjusted under 35 U.S.C. 154(b) by 0 days.

(21) Appl. No.: 12/077,870

(22) Filed: Mar. 20, 2008

(65) Prior Publication Data

US 2008/0168832 A1 Jul. 17, 2008

Related U.S. Application Data

(60) Division of application No. 11/336,609, filed on Jan. 20, 2006, now Pat. No. 7,377,371, which is a continuation of application No. PCT/EP2004/008025, filed on Jul. 17, 2004.

(30) Foreign Application Priority Data

Jul. 22, 2003 (DE) ..... 103 34 654

(51) Int. Cl.
*B66B 5/04* (2006.01)

(52) U.S. Cl. ..... 188/188; 188/65.1

(58) Field of Classification Search ..... 188/180, 188/188, 189, 2 D, 65.1, 65.4, 65.5; 187/200, 187/300, 393

See application file for complete search history.

(56) References Cited

U.S. PATENT DOCUMENTS

| | | | |
|---|---|---|---|
| 1,713,228 | A | 5/1929 | Harrington |
| 5,197,571 | A | 3/1993 | Burrell et al. |
| 5,228,540 | A | 7/1993 | Glaser |
| 5,234,079 | A | 8/1993 | Nomura |
| 6,802,402 | B2 | 10/2004 | Bausch et al. |

FOREIGN PATENT DOCUMENTS

| | | |
|---|---|---|
| EP | 0 708 051 | 4/1996 |
| WO | 02/32801 | 4/2002 |

*Primary Examiner*—Xuan Lan Nguyen
(74) *Attorney, Agent, or Firm*—Lipsitz & McAllister, LLC

(57) ABSTRACT

A rope brake for an elevator installation for braking a rope coupled to a car is provided, which has a stop that is immovable in the longitudinal direction of the rope and at least one brake shoe. The rope is led between the stop and the brake shoe, and the brake shoe is adapted to be moved back and forth between a braking position, pressing the rope against the stop, and a release position, releasing the rope. A drive coupled to the brake shoe is provided for releasing the rope. The drive is formed as a linear drive and the at least one brake shoe can be transferred by means of the linear drive into its release position against the action of a braking force acting on it in the braking position. Methods for testing a rope brake for an elevator car having a movable brake shoe are also provided.

6 Claims, 4 Drawing Sheets

ROPE BRAKE

This application is divisional of commonly-owned co-pending U.S. application Ser. No. 11/336,609 which is a continuation of international application number PCT/EP2004/008025 filed on Jul. 17, 2004 and which claims the benefit of German application number 103 34 654.6 of Jul. 22, 2003, each of which is incorporated herein by reference in their entirety and for all purposes.

BACKGROUND OF THE INVENTION

The invention relates to a rope brake for an elevator installation for braking a rope coupled to a car, with a stop that is immovable in the longitudinal direction of the rope and at least one brake shoe, it being possible for the rope to be led through between the stop and the brake shoe, and it being possible for the brake shoe to be moved back and forth between a braking position, pressing the rope against the stop, and a release position, releasing the rope, and with a linear drive coupled to the brake shoe for releasing the rope, the at least one brake shoe being able to be transferred by means of the linear drive into its release position against the action of a braking force acting on it in the braking position.

Rope brakes are known, for example, from EP 0 708 051 A1. They can be used for example for reliably braking a rope that is coupled to a counterweight of the elevator installation and is held on the car that can be made to travel up and down along a traveling path, in that the at least one movably disposed brake shoe assumes its braking position and the rope is thereby pressed against the stop. To transfer the brake shoe into its release position, an electric motor is used in the case of the rope brake that is known from EP 0 708 051 A1, which motor is coupled by means of a chain linkage and a magnetic coupling to a shaft, fixed to one end of which is a spiral spring that is fixedly held at the other end and is in operative connection by means of a thread with a piston that is held such that it is displaceable and rotationally fixed and on which the movable brake shoe is held. The electric motor provides a rotary drive which sets the shaft in rotation, so that the spiral spring is tensioned and at the same time the brake shoe is transferred into its release position. If the rope is to be braked, the magnetic coupling is released and, as a result, the operative connection between the rotary drive and the shaft is interrupted. This then has the consequence that the spiral spring is relaxed, the shaft being set in rotation and, as a result, the brake shoe moved in the direction of the stop, so that the rope is pressed against the stop. The actual braking force is produced by a spring force which acts on the stop that is immovable in the longitudinal direction of the rope but movable in the transverse direction of the rope. For the movable brake shoe, this requires an additional distance which must be covered, since the stop that is displaceable in the transverse direction of the rope can give way until the braking force is built up.

The rope brake known from EP 0 708 051 A1 has a complex construction with a large number of components. This makes the rope brake susceptible to faults. Furthermore, the braking process that can be achieved by means of the rope brake is relatively slow, since a not inconsiderable time is required to allow the rope to be effectively braked by means of the rotation in the thread after the rope brake is activated.

U.S. Pat. No. 5,228,540 discloses a rope brake in which the brake shoe can be transferred into its braking position by means of a pivoting lever. For this purpose, two compression springs and a hydraulic piston-cylinder assembly are articulated on the free end of the pivoting lever. The compression springs permanently exert on the pivoting lever a spring force which attempts to pivot the pivoting lever in such a way that the brake shoe assumes its braking position. Counter to the action of the compression springs, the pivoting lever may be held by means of the piston-cylinder assembly in a position in which the brake shoe releases the rope. If the brake shoe is to assume its braking position, for this purpose the pivoting lever must be pivoted and at the same time the piston of the piston-cylinder assembly moved counter to the pressure medium acting on it. This has the consequence that the braking force provided by the compression springs is only partly available to the brake shoe for braking the rope, since part of the braking force must be used for moving the piston. Furthermore, the braking process that can be achieved is relatively slow, since some time is required to allow the rope to be effectively braked by means of the pivoting movement of the pivoting lever after the rope brake is activated.

It is an object of the present invention to develop a rope brake of the type mentioned at the beginning in such a way that it has a simpler construction and with it the rope can be braked within a shorter time.

SUMMARY OF THE INVENTION

This object is achieved according to the invention in the case of a rope brake of the generic type by it being possible for the coupling between the linear drive and the brake shoe to be established and interrupted according to choice.

The brake shoe is permanently subjected to a braking force in its braking position, and the brake shoe can be transferred into its release position by means of the linear drive counter to the action of the braking force. For this purpose, the linear drive can be coupled to the brake shoe. If the coupling is interrupted, within a very short time the brake shoe assumes its braking position, in which it presses the rope against the stop, so that the rope can be braked within a short time. To release the rope, in addition to the braking force acting on the brake shoe, the coupling to the linear drive has the effect that the brake shoe is subjected to an actuating force of the linear drive acting counter to the braking force, so that it can be transferred into its release position under the action of the actuating force. The use of a linear drive makes it possible here to obtain a simple construction of the rope brake, which can be used for example for braking the suspension ropes of an elevator installation. It may also be envisaged to brake a rope of the elevator installation that is coupled to a speed limiter within a very short time by means of a rope brake of this type.

The construction according to the invention also has the advantage that the function of the rope brake can be tested automatically, for example every time the car is stopped. All that is required for this purpose is to transfer the brake shoe into its two end positions one after the other, that is into its braking position and into its release position, while the car is stationary and electrically test switching positions of at least one position switch, the switching positions corresponding to the end positions of the brake shoe. The method for testing the rope brake according to the invention is explained in more detail below.

It is of particular advantage if the at least one brake shoe can be moved back and forth between its braking position and its release position by means of the linear drive. In this case, not only can the brake shoe be transferred out of its braking position into its release position by means of the linear drive, but also the brake shoe can be made to undergo a controlled movement out of its release position into its braking position under the action of the linear drive.

The linear drive may be used in a wide variety of configurations; for example, it may be configured as an electric, hydraulic or pneumatic drive, in particular as a linear motor or as a piston-cylinder assembly. It is of advantage if the linear drive is configured as a threaded-spindle or screw drive. This makes it possible for the rope brake to be constructed in a way that is particularly simple and can be produced at low cost.

In the case of a preferred embodiment, the at least one brake shoe is coupled to the linear drive by means of a pivotably mounted pivoting lever. A one-armed pivoting lever or else a two-armed pivoting lever may be provided here. The use of a pivoting lever makes possible a force transmission of such a kind that the brake shoe can be subjected to a great braking force in its braking position, while only a relatively low actuating force has to be provided by the linear drive to allow the brake shoe to be transferred into its release position in spite of the effective braking force.

It has proven to be advantageous if the rope brake comprises a spring element which subjects the at least one brake shoe to the braking force in its braking position. The spring element is preferably formed as a spring with a linear characteristic, so that the spring element subjects the brake shoe to a braking force that is proportional to the spring excursion. The spring element may be configured for example as a cup spring or helical spring.

In the case of a preferred embodiment, the spring element interacts with the at least one brake shoe by means of a pivotably mounted pivoting lever. The use of a one-armed or two-armed pivoting lever which is disposed between the spring element and the brake shoe has the advantage that a very high braking force can be exerted on the brake shoe even when a relatively small spring force is provided. It is also of advantage here that the braking force is built up on the brake shoe side and not on the stop side, since a fixed and unyielding stop allows the deflecting displacement of the rope to be braked to be kept small.

In the case of a configuration of a particularly simple construction, it is provided that both the spring element and the linear drive are coupled to the at least one brake shoe by means of the pivoting lever. Consequently, only a single pivoting lever is used, by means of which the brake shoe can be subjected both to the actuating force provided by the linear drive and to the spring force provided by the spring element. It is advantageous here if the spring element and the linear drive are disposed in line with each other.

For example, it may be provided that the spring element is coupled to the pivoting lever by means of a force transmission element, for example a rod, that is in line with the linear drive. The force transmission element may in this case be articulated on the pivoting lever.

In order additionally to speed up the activation of the rope brake according to the invention, it is of advantage if the at least one brake shoe is coupled to the linear drive by means of an electromagnet and an armature associated with it. To activate the rope brake, it is then merely necessary to switch off the energizing current of the electromagnet in order to disconnect the brake shoe from the linear drive, so that the actuating force provided by the linear drive is discontinued and the brake shoe transfers into its braking position within a very short time on account of the spring force acting on it.

It has proven to be advantageous if the electromagnet and the armature are disposed between the pivoting lever, coupled to the at least one brake shoe, and the linear drive. Alternatively, it may be provided that the electric motor and the armature are disposed directly adjacent to the movable brake shoe.

It is of advantage if the armature or the electromagnet is articulated on the pivoting lever. As a result, the rope brake can be formed with a particularly smooth action, it being possible for frictional forces occurring between the individual components to be kept small.

In the case of a preferred embodiment, the electromagnet and/or the armature are held in a linearly displaceable manner. For example, it may be provided that the electromagnet and/or the armature can be made to move linearly by means of the linear drive. This makes it possible to displace the armature and/or the electromagnet by means of the linear drive, so that the distance between the electromagnet and the armature can be set by means of the linear drive.

The electromagnet and/or the armature are preferably held in such a way that they can be made to move on a fixed stand, on which the linear motor and the spring element are disposed. The stand may be a base of the rope brake that can be fixed in the shaft of the elevator installation or in its machine room, carries the linear motor and the spring element and has a guide for the movably held electromagnet or the movably held armature.

Instead of using an electromagnet with an associated armature, the linear drive itself may be configured with a releasable connecting element, for example a clutch.

It is of advantage if an elastic element is arranged between the linear drive and the electromagnet or the armature. This makes it possible for the electromagnet or armature to be elastically secured to the linear drive by means of a sprung intermediate region. This makes it possible that, even when a rope becomes thinner or braking surfaces of the stop become worn over time, the linear drive can always move to the same place without the actuating travel of the linear drive having to be adjusted. By means of the elastic element, the linear drive can push the electromagnet and the armature together and the linear drive can subsequently be switched off without distortions occurring.

It is advantageous if the pivoting lever is pivotably mounted on the stand.

In the case of a particularly preferred embodiment of the rope brake according to the invention, the position of an actuating element of the linear drive, of a force transmission element of the spring element and/or the position of the pivoting lever can be monitored by at least one sensor. This may be a contactless sensor, for example a reed contact or Hall sensor, but a sensor with contacts may also be used. In particular, it may be provided that at least one sensor is configured as an electric, pneumatic or hydraulic position switch. An electrical switching contact, which can be actuated by means of a control push rod, may be used for example as the position switch. If the actuating element, the force transmission element or the pivoting lever assumes a position which corresponds to an end position of the brake shoe, the control push rod of an associated switching contact can be actuated by the actuating element, the force transmission element or the pivoting lever. The assumed switching position of the switching contact can then be electrically tested at any time, in order in this way to determine the position of the associated actuating element, force transmission element or pivoting lever.

As mentioned at the beginning, the invention also relates to a method for functionally testing a rope brake. This is distinguished according to the invention by the movable brake shoe being brought into its two end positions one after the other while the car is stationary and switching positions of at least one position switch being electrically tested, the switching positions corresponding to the end positions of the brake shoe. Functional testing of this type can be automatically carried out for example each time the car of the elevator installation is stopped. The at least one position switch may interact directly with the brake shoe, but it may also be provided that the position switch interacts with a component of the rope brake that is mechanically coupled to the brake shoe, for example with the pivoting lever or the force transmission element of the spring element.

For functionally testing the rope brake, the at least one brake shoe is preferably transferred by means of the linear drive into its two end positions, i.e. the brake shoe is made to undergo a controlled movement by means of the linear drive while the car is stationary, it assuming its two end positions one after the other. In the end positions of the brake shoes, the respective switching positions of the at least one position switch can then be electrically tested.

It is of advantage if switching positions of at least one position switch associated with the pivoting lever are electrically tested, the switching positions corresponding to the end positions of the brake shoe. In this way it is possible, for example when a car is stopped, to test within a short time whether the pivoting lever can assume its end positions that respectively correspond to an end position of the brake shoe. This makes it possible for example for a mechanical blockage of the pivoting lever to be readily detected.

The function of an interrupter unit connected into a power supply line of the electromagnet is preferably tested in the braking position of the at least one brake shoe. In this way it is possible while the car is stationary and once the proper braking position of the brake shoe has been tested directly or indirectly, to check the switching off of the energizing current of the electromagnet, i.e. it can be tested whether, in the event of a fault of the elevator installation, the electromagnet can be reliably switched off for braking the rope.

It is of particular advantage if, once its energizing current has been switched off, the electromagnet is made to move by means of the linear motor into its position corresponding to the release position of the brake shoe and the switching position of at least one position switch associated with the pivoting lever or the brake shoe is electrically tested. In this way it is possible when a car is stationary to detect whether the position of the brake shoe or of the pivoting lever changes once the switched-off electromagnet is displaced by the linear motor. If the rope brake is functioning properly, a displacement of the switched-off electromagnet should not result in any change in the location of the brake shoe and the pivoting lever. If a change in location of this type is detected from the switching position of the associated position switch, the rope brake is faulty.

In the case of a particularly preferred embodiment of the testing method according to the invention, it is provided that, once the electromagnet has been displaced by the linear drive in the switched-off state, it is subsequently made to return by means of the linear drive back into its position corresponding to the braking position of the brake shoe, then the electromagnet is again subjected to the energizing current and after that it is once again made to move by means of the linear drive into its position corresponding to the release position of the brake shoe and the switching position of the position switch associated with the pivoting lever and/or the brake shoe is electrically tested. In the case of this advantageous embodiment of the testing method according to the invention, the energized electromagnet is therefore displaced by means of the linear drive and it is then tested whether the position of the brake shoe and/or the pivoting lever changes. If the rope brake is operating properly, a change in the location of the brake shoe and of the pivoting lever must be detectable in this case, otherwise there is a fault.

The following description of two preferred embodiments of the invention serves for more detailed explanation in conjunction with the drawing.

DETAILED DESCRIPTION OF THE INVENTION

Figure 1:
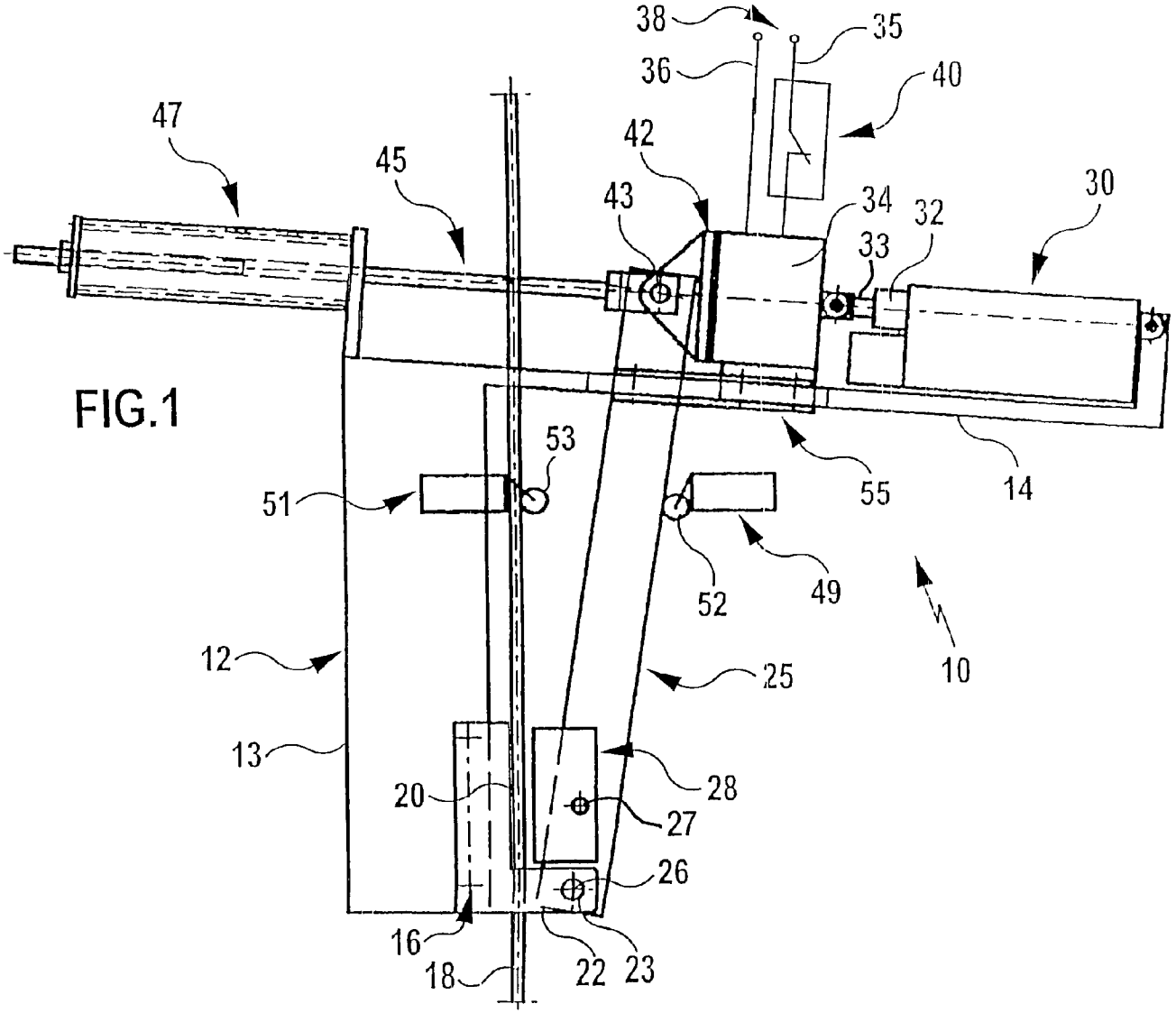
FIG. 1 shows a schematic representation of a first embodiment of a rope brake according to the invention with a brake shoe in its release position.
Figure 2:
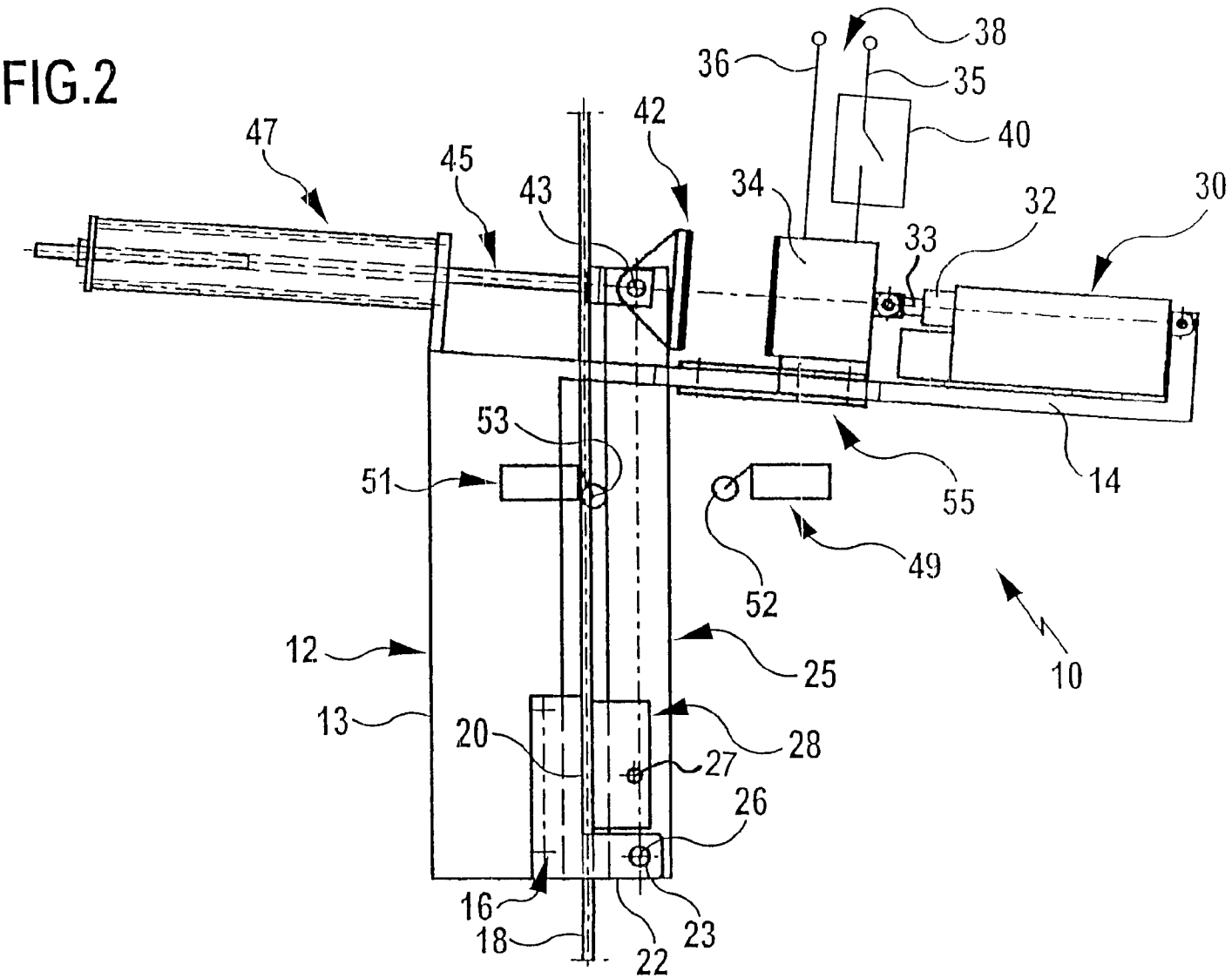
FIG. 2 shows a schematic representation corresponding to FIG. 1 with the brake shoe in its braking position.

In FIGS. 1 and 2, a first embodiment of a rope brake according to the invention is represented and provided overall with the reference numeral 10. This brake comprises a substantially L-shaped stand 12, which is held fixed in place in an elevator shaft or the machine room of an elevator installation and has a first leg 13 and a second leg 14. Fixed at the free end of the first leg 13 is a stop 16, which is aligned parallel to a rope 18 to be braked of the elevator installation and carries on its front side, facing the rope 18, a brake lining 20. From the stop 16 there extends an extension arm 22, articulated on which by means of a bearing 23 is a pivoting lever 25, which is pivotable about a pivot axis 26 aligned perpendicularly in relation to the longitudinal direction of the rope 18. Articulated on the pivoting lever 25 by means of a bearing 27 is a movable brake shoe 28, which is aligned parallel to the stop 16. The rope 18 is led through between the stop 16 and the movable brake shoe 28 and can be braked by the brake shoe 28 being moved by means of the pivoting lever 25 out of its release position, represented in FIG. 1, into its braking position, represented in FIG. 2, in which the brake shoe 28 presses the rope 18 against the brake lining 20 of the stop 16.

The second leg 14 of the stand 12 carries in the region of its free end a linear drive 30. This may be, for example, an electric linear motor or else a hydraulic or pneumatic piston-cylinder assembly. The linear drive 30 has an actuating element 32, which can be moved by it in a straight line parallel to the second leg 14. The actuating element 32 may, for example, take the form of a piston rod. Disposed at the free end of the actuating element 32 is an elastic element 33, by means of which the actuating element 32 is coupled to an electromagnet 34, which is connected via electrical power supply lines 35, 36 to a voltage source 38. Arranged in the power supply line 35 is an interrupter unit 40, with the aid of which the electrical connection between the voltage source 38 and the electromagnet 34 can be established and interrupted as and when required.

The electromagnet 34 interacts with an armature 42, which is articulated on the free end of the pivoting lever 25 by means of a bearing 43. In addition to the armature 42, articulated on the pivoting lever 25 by means of the bearing 43 is a force transmission element in the form of a brake spring rod 45, which is fixed by its end remote from the bearing 43 to a brake spring 47, which is formed as a helical spring and is held fixed in place on the stand 12. The linear motor 30 and the brake spring rod 45 are in line with each other, and, by means of the brake spring 47, the pivoting lever 25 is subjected to a spring force away from the linear motor 30 via the brake spring rod 45, while an actuating force which acts against the brake spring 47, and consequently acts against the spring force, is exerted on the pivoting lever 25 by the linear motor 30 via the actuating element 32, the elastic element 33, the electromagnet 34 and the armature 42.

The pivoting position assumed by the pivoting lever 25 in the release position and the braking position of the brake shoe 28 is in each case detected by an electrical position switch 49 and 51, respectively. For this purpose, the two position switches 49, 51 have in each case a switching cam 52 and 53, respectively, against which the pivoting lever 25 can be placed and on the basis of the actuation of which the respective position switch 49 or 51 changes its switching position. The switching position of the position switches 49 and 51 can be electrically monitored in a customary way by means of signal lines that are known per se and are therefore not represented in the drawing to achieve a better overview.

The electromagnet 34 is held on the second leg 14 of the stand 12 in such a way that it is displaceable in the longitudinal direction of the second leg 14 by means of a guiding device 55 which is known per se and therefore only schematically represented in the drawing.

If the rope 18 is to be braked, for this purpose the electrical supply line 35 can be interrupted by means of the interrupter unit 40, i.e. the energizing current of the electromagnet 34 can be switched off. This has the consequence that the electromagnet 34 releases the armature plate 42, and this in turn has the effect that the pivoting lever 25 is pivoted on account of the spring force permanently exerted on it by the brake spring 47 in such a way that the movable brake shoe 28 presses the rope 18 against the brake lining 20 of the stop 16. This is represented in FIG. 2. The pivoting position of the pivoting lever 25 corresponding to the braking position of the movable brake shoe 28 can be checked by means of the electrical position switch 51.

If the braked rope 18 is subsequently to be released again, for this purpose the displaceably mounted electromagnet 34 can be displaced in the direction of the armature 42 by means of the actuating element 32 and at the same time the energizing current of the electromagnet 34 can be switched on again by means of the interrupter unit 40, so that the electromagnet 34 brought up to the armature 42 exerts a magnetic holding force on the armature 42. Subsequently, the electromagnet 34 can be subjected by the actuating element 32 to an actuating force acting against the spring force of the brake spring 47, and exceeding it, so that the electromagnet 34 is displaced back along the guiding device 55, with the pivoting lever 25 at the same time being pivoted in such a way that the movable brake shoe 28 assumes its release position. This is represented in FIG. 1. The pivoting position of the pivoting lever 25 corresponding to the release position of the brake lever 28 can be checked by means of the electrical position switch 49.

Functional testing of the rope brake 10 can be performed for example when a car is stopped, in that the linear drive 30 displaces the electromagnet 34 in the direction of the brake spring 47 until the electrical position switch 51 is actuated and consequently the pivoting lever 25 assumes its pivoting position corresponding to the braking position of the brake shoe 28. Subsequently, the electromagnet 34 can be deenergized by means of the interrupter unit 40 and the currentless state of the magnet checked. In a further test step, the currentless electromagnet 34 can be displaced by the linear drive 30 in the direction away from the brake spring 47 and it can then be tested whether the electrical position switch 51 changes its switching position. This would mean that there is a malfunction of the rope brake 10, since, when the electromagnet 34 is deenergized, changing its position does not have any influence on the pivoted position of the pivoting lever 25. In a further test step, the still deenergized electromagnet 34 can once again be made to travel in the direction of the brake spring 47 and subsequently be subjected to the energizing current by means of the interrupter unit 40, so that it exerts a magnetic holding force on the armature 42. In a further test step, the electromagnet 34 subjected to energizing current can be displaced once again in the direction away from the brake spring 47, it being possible to test whether the electrical position switches 51 and 49 change their switching position on account of the pivoting movement of the pivoting lever 25. Once the electrical position switch 49 has indicated that the pivoting lever 25 has assumed its pivoted position corresponding to the release position of the brake shoe 28, normal operation of the elevator installation can be resumed.

Figure 3:
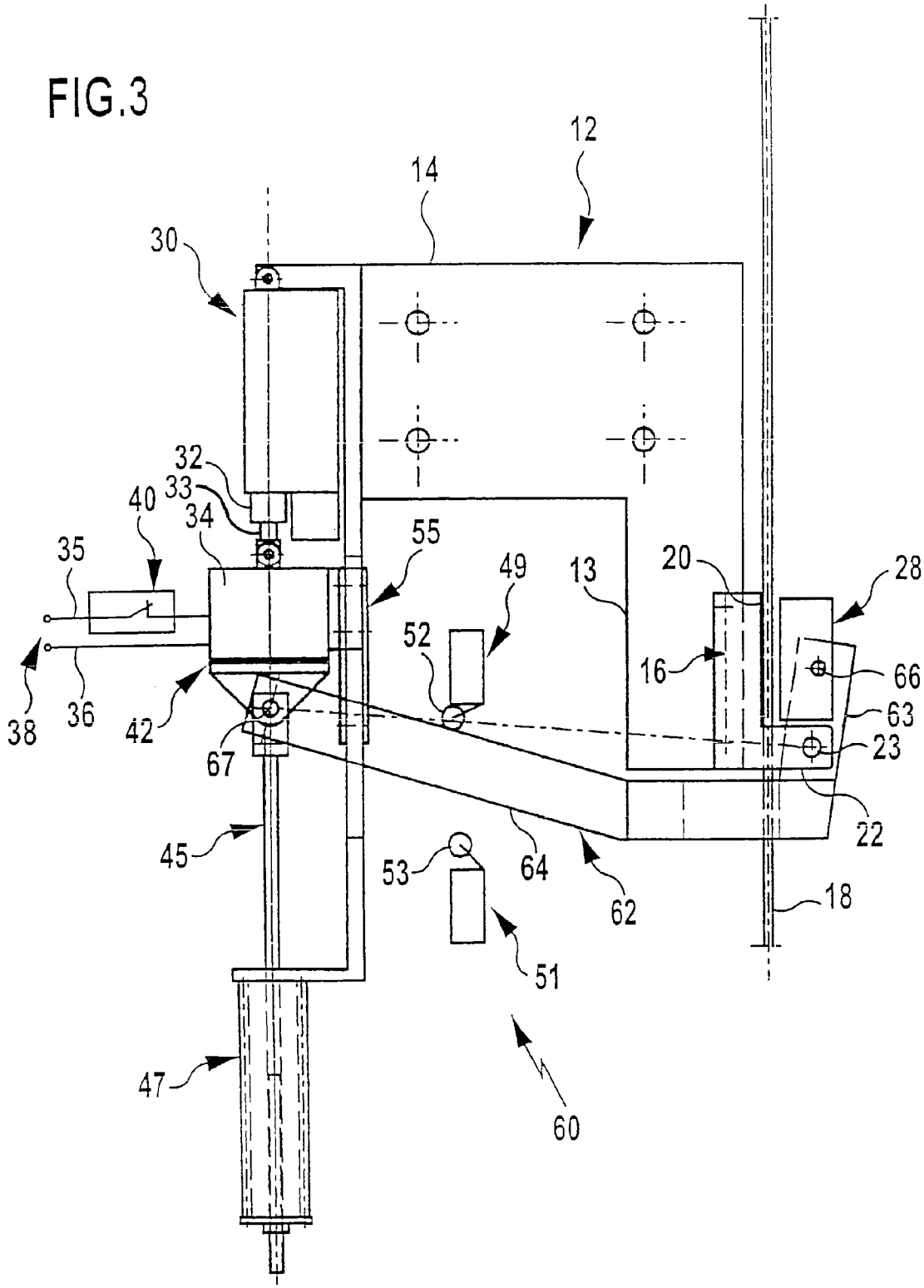
FIG. 3 shows a schematic representation of a second embodiment of a rope brake according to the invention with a brake shoe in its release position and FIG. 4 shows a schematic representation corresponding to FIG. 3 with the brake shoe in its braking position.
Figure 4:
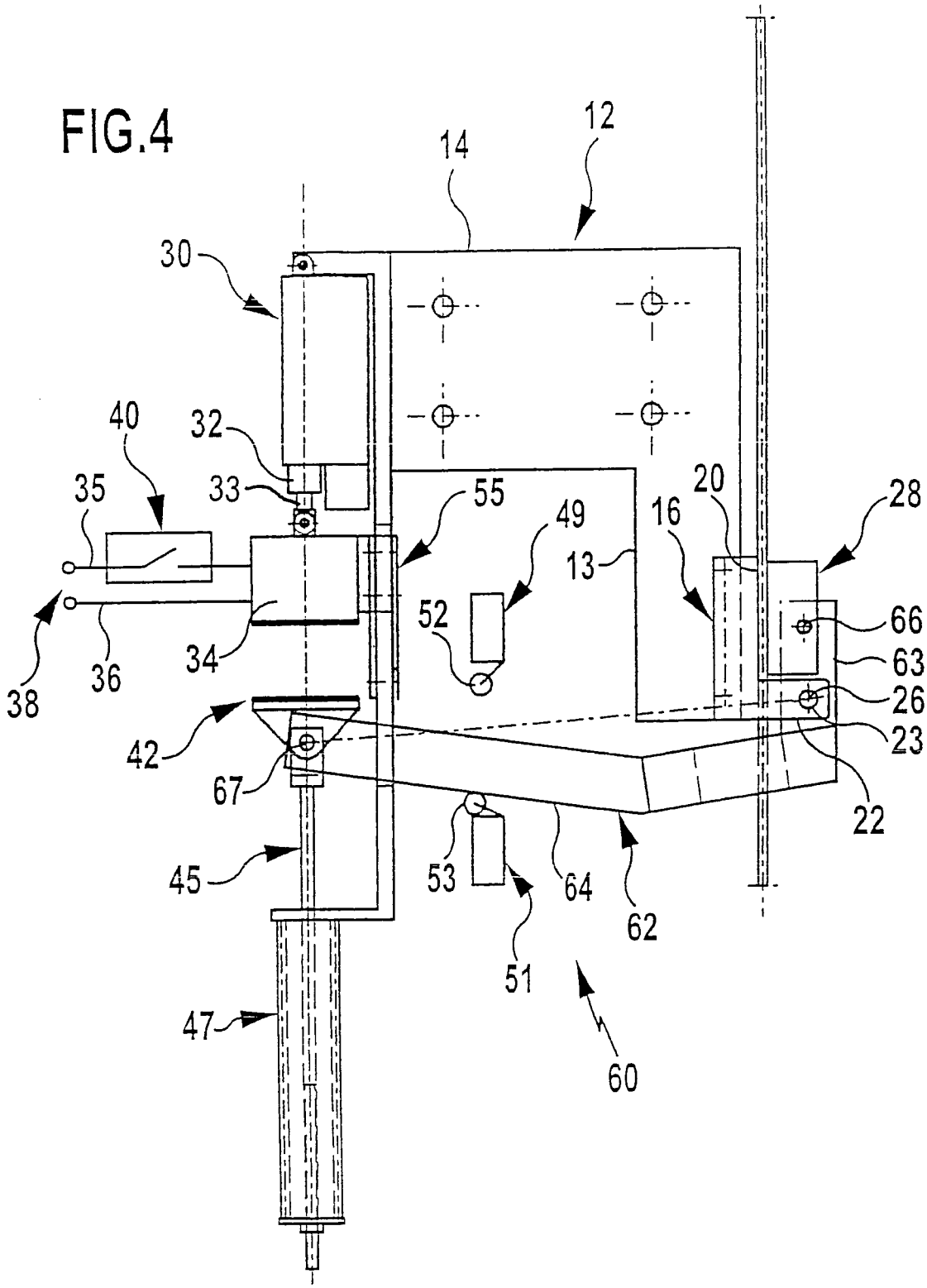

In FIGS. 3 and 4, a second embodiment of a rope brake according to the invention is represented and provided overall with the reference numeral 60. This is constructed largely identically to the rope brake 10 explained above with reference to FIGS. 1 and 2. Therefore, the same reference numerals as in FIGS. 1 and 2 are used for components that are identical or functionally the same in FIGS. 3 and 4. To avoid repetition, reference is made in this respect to the full content of the explanations given above.

The rope brake 60 likewise has a fixed-in-place stand 12, which is configured in a substantially L-shaped manner and comprises a first leg 13 and a second leg 14. The rope 18 to be braked is once again led through between a stop 16, which is held on the first leg 13 immovably in the longitudinal direction of the rope 18 and has a brake lining 20, and a movable brake shoe 28. While a one-armed pivoting arm 25, on which the movable brake shoe 28 is articulated between the bearings 23 and 43, is used in the case of the rope brake 10 represented in FIGS. 1 and 2, a two-armed pivoting lever 62, which is configured in an approximately L-shaped manner and comprises a long first lever arm 64 and a short second lever arm 63, is used in the case of the rope brake 60 represented in FIGS. 3 and 4. For mounting the pivoting lever 62 on the stand 12, once again an extension arm 22, which protrudes from the stop 16 and carries a bearing 23, is used. The movable brake shoe 28 is held at the free end of the second lever arm 63 by means of a bearing 66, and the armature 42 of the rope brake 60 as well as the free end of the brake spring rod 45 are articulated by means of a bearing 67 at the free end of the first lever arm 64.

The armature 42 interacts with an electromagnet 34, which can be displaced by means of a linear drive 30 parallel to the longitudinal direction of the rope 18 via a guiding device 55. The pivoting lever 62 is permanently subjected by the brake spring 47 to a spring force, which is directed counter to the actuating force exerted by the linear motor 30 on the pivoting lever 62 via the electromagnet 34 and the armature 42 in the release position of the movable brake shoe 28. In the case of the rope brake 60, too, the linear motor 30, the brake spring rod 45 and the brake spring 47 are in line with one another. As a difference from the rope brake 10, however, they are disposed parallel to the longitudinal direction of the rope 18. The rope brake 60 therefore has a particularly narrow form of construction, while the rope brake 10 represented in FIGS. 1 and 2 has a wide, but short form of construction in relation to the longitudinal direction of the rope 18.

The function of the rope brake 60 can be automatically tested for example when a car is stopped, in that the magnet 34 is displaced back and forth by means of the linear drive 30 and the pivoted position respectively assumed by the pivoting lever 62 is tested by means of the electrical position switches 49 and 51.

What is claimed is:

1. Method for functionally testing a rope brake for an elevator car having a movable brake shoe, comprising:

moving the brake shoe into a first end position while the car is stationary;

moving the brake shoe into a second end position while the car is stationary; and testing switching positions of at least one position switch, the switching positions corresponding to the end positions of the brake shoe;

the rope brake comprising:

a stop that is immovable in a longitudinal direction of the rope;

the movable brake shoe, the rope being led between the stop and the brake shoe, the brake shoe adapted to be moved back and forth between a braking position, pressing the rope against the stop, and a release position, releasing the rope;

a linear drive;

a releasable coupling for releasably connecting the linear drive to the brake shoe, the brake shoe adapted to be transferred by means of the linear drive into the release position against the action of a braking force acting on the brake shoe in the braking position;

wherein the connection between the linear drive and the brake shoe is adapted to be established and interrupted via the releasable coupling.

2. Method according to claim 1, wherein the brake shoe is transferred into the first and second end positions one after the other by means of the linear drive.

3. Method according to claim 1, wherein:

the coupling connecting the linear drive to the brake shoe comprises a pivotably mounted pivoting lever, and switching positions of at least one position switch associated with the pivoting lever are electrically tested, the switching positions corresponding to the end positions of the brake shoe.

4. Method according to claim 3, wherein:

the coupling connecting the linear drive to the brake shoe further comprises an electromagnet, and the function of an interrupter unit connected into a power supply line of the electromagnet is tested in the braking position of the brake shoe.

5. Method according to claim 4, wherein, once an energizing current has been switched off, the electromagnet is made to move by means of the linear drive into a position corresponding to the release position of the brake shoe and the switching positions of at least one position switch associated with the pivoting lever or the brake shoe are electrically tested.

6. Method according to claim 5, wherein the electromagnet is subsequently made to return by means of the linear drive back into a position corresponding to the braking position of the brake shoe, then the electromagnet is again subjected to the energizing current and made to move by means of the linear drive into its position corresponding to the release position of the brake shoe and the switching positions of the position switch associated with at least one of the pivoting lever and the brake shoe are electrically tested.

* * * * *